US011111823B2

(12) United States Patent
Jarrossay et al.

(10) Patent No.: US 11,111,823 B2
(45) Date of Patent: Sep. 7, 2021

(54) TURBINE RING ASSEMBLY WITH INTER-SECTOR SEALING

(71) Applicant: SAFRAN AIRCRAFT ENGINES, Paris (FR)

(72) Inventors: Clément Jarrossay, Moissy-Cramayel (FR); Sébastien Serge Francis Congratel, Moissy-Cramayel (FR); Antoine Claude Michel Etienne Danis, Moissy-Cramayel (FR); Clément Jean Pierre Duffau, Moissy-Cramayel (FR); Lucien Henri Jacques Quennehen, Moissy-Cramayel (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 0 days.

(21) Appl. No.: 17/047,973

(22) PCT Filed: Apr. 4, 2019

(86) PCT No.: PCT/FR2019/050797

§ 371 (c)(1),
(2) Date: Oct. 15, 2020

(87) PCT Pub. No.: WO2019/202234

PCT Pub. Date: Oct. 24, 2019

(65) Prior Publication Data

US 2021/0164366 A1 Jun. 3, 2021

(30) Foreign Application Priority Data

Apr. 16, 2018 (FR) ..... 1853302

(51) Int. Cl.

| | |
|---|---|
| ***F01D 25/24*** | (2006.01) |
| ***F01D 11/08*** | (2006.01) |
| ***F01D 25/12*** | (2006.01) |

(52) U.S. Cl.
CPC ..... *F01D 25/246* (2013.01); *F01D 11/08* (2013.01); *F01D 25/12* (2013.01);
(Continued)

(58) Field of Classification Search
CPC ..... F01D 9/04; F01D 11/08; F01D 11/005; F01D 25/12; F01D 25/246;
(Continued)

(56) References Cited

U.S. PATENT DOCUMENTS

| | | | | |
|---|---|---|---|---|
| 9,874,104 | B2 * | 1/2018 | Shapiro | F01D 25/246 |
| 2005/0249584 | A1 * | 11/2005 | Amiot | F01D 9/04 415/115 |

(Continued)

FOREIGN PATENT DOCUMENTS

| | | | |
|---|---|---|---|
| EP | 2 987 959 | A1 | 2/2016 |
| WO | WO 2017/060604 | A1 | 4/2017 |
| WO | WO 2018/004583 | A1 | 1/2018 |

OTHER PUBLICATIONS

International Search Report as issued in International Patent Application No. PCT/FR2019/050797, dated Jul. 11, 2019.

*Primary Examiner* — Igor Kershteyn
(74) *Attorney, Agent, or Firm* — Pillsbury Winthrop Shaw Pittman LLP

(57) ABSTRACT

A turbine ring assembly includes adjacent ring sectors forming a turbine ring, each ring sector having a platform with an inner face defining the inner face of the turbine ring and an outer face from which an upstream lug and a downstream lug extend along the radial direction. Each ring sector includes a first groove present in the platform in the vicinity of the inner face of the platform, a second groove present in the platform in the vicinity of the outer face of the platform, an upstream groove extending into the upstream lug and a downstream groove extending into the downstream lug. A first sealing tab extends into the first groove.
(Continued)

A second sealing tab extends into the second groove. An upstream sealing tab extends into the upstream groove. A downstream sealing tab extends into the downstream groove. The second sealing tab includes at least one opening.

10 Claims, 4 Drawing Sheets

(52) U.S. Cl.
CPC ..... *F05D 2230/60* (2013.01); *F05D 2240/11* (2013.01); *F05D 2240/55* (2013.01); *F05D 2260/201* (2013.01); *F05D 2300/6033* (2013.01)

(58) Field of Classification Search
CPC ..... F05D 2220/323; F05D 2230/60; F05D 2240/11; F05D 2260/201; F05D 2300/6033
See application file for complete search history.

(56) References Cited

U.S. PATENT DOCUMENTS

| | | | | |
|---|---|---|---|---|
| 2011/0318171 | A1* | 12/2011 | Albers | F01D 25/246 415/173.1 |
| 2016/0053633 | A1* | 2/2016 | Webb | F01D 11/00 415/177 |
| 2018/0371948 | A1* | 12/2018 | Lepretre | F01D 25/246 |
| 2019/0040758 | A1* | 2/2019 | Quennehen | F01D 11/08 |
| 2019/0136707 | A1* | 5/2019 | Palmer | F01D 11/18 |

* cited by examiner

TURBINE RING ASSEMBLY WITH INTER-SECTOR SEALING

CROSS-REFERENCE TO RELATED APPLICATIONS

This application is the U.S. National Stage of PCT/FR2019/050797, filed Apr. 4, 2019, which in turn claims priority to French patent application number 1853302 filed Apr. 16, 2018. The content of these applications are incorporated herein by reference in their entireties.

BACKGROUND OF THE INVENTION

The invention relates to a turbine ring assembly for a turbomachine, which assembly comprises a plurality of one-piece ring sectors made of ceramic-matrix composite material or of metal material and a ring support structure.

The field of application of the invention is in particular that of gas turbine aeronautical engines. The invention is however applicable to other turbomachines, for example industrial turbines.

The ceramic-matrix composite or CMC materials are known for their good mechanical properties which make them suitable for constituting structural elements, and for their ability to maintain these properties at high temperatures. The use of CMC for various hot parts of aeronautical engines has already been considered, especially as CMC have a density lower than that of traditionally used refractory metals.

Thus, the production of a turbine ring assembly from CMC ring sectors is in particular described in document WO 2017/060604. The ring sectors include an annular base whose inner face defines the inner face of the turbine ring and an outer face from which extend two parts forming lugs whose ends are engaged in housings of a ring support metal structure.

The use of CMC ring sectors allows significantly reducing the ventilation required for cooling the turbine ring. However, the sealing between the gas flowpath on the internal side of the ring sectors and the external side of the ring sectors remains a problem.

As described in document WO 2017/060604, sealing tabs are disposed in grooves arranged in the faces of the adjacent ring sectors in order to establish a sealing between the ring sectors. The sealing tabs generally have small dimensions, particularly in thickness, to be easily made of CMC.

In order to improve the performances of the turbines, particularly their efficiency, ever higher operating temperatures are sought. If the CMC rings withstand relatively high temperatures (which can exceed 1,500° C.), the sealing tabs made of metal material are more sensitive to high temperatures. Therefore, the temperature level to which the CMC rings can be subjected is limited by the presence of the sealing tabs.

OBJECT AND SUMMARY OF THE INVENTION

The invention aims at allowing a high-temperature use of the CMC turbine rings and proposes for this purpose a turbine ring assembly comprising a plurality of adjacent ring sectors forming a turbine ring extending circumferentially around an axial direction, each ring sector having a first part forming a platform with, along a radial direction of the turbine ring, an inner face defining the inner face of the turbine ring and an outer face from which an upstream lug and a downstream lug extend along the radial direction, each ring sector comprising a first groove present in the platform in the vicinity of the inner face of said platform, a second groove present in the platform in the vicinity of the outer face of said platform, the first and the second groove extending along the axial direction of the turbine ring, an upstream groove extending radially into the upstream lug and a downstream groove extending radially into the downstream lug, a first sealing tab extending into the first groove, a second sealing tab extending into the second groove, an upstream sealing tab extending into the upstream groove and a downstream sealing tab extending into the downstream groove, the ring support structure comprising ventilation elements making it possible to bring a cooling stream onto the outer face of the platform, characterized in that the second sealing tab includes one or several opening(s).

The opening (s) present in the second sealing tab, namely the tab closest to the outer face of the platform of each ring sector which is intended to receive a cooling stream, allow the cooling stream to pass through this second sealing tab and to impact the first sealing tab, namely the sealing tab most exposed to heat streams. It is thus possible to cool the first sealing tab which can then be exposed to streams of higher temperatures. In addition, the air stream used to impact the first sealing tab also allows reloading the pressure in the area located between the first and second sealing tabs. The risk of reintroducing hot air of the flowpath into this area is thus reduced. The faces opposite the adjacent ring sectors and the sealing tabs are therefore better protected from the high temperature streams.

According to a first aspect of the ring assembly of the invention, the upstream groove opens into the second groove, the downstream groove opening into the first and second grooves, each ring sector comprising:

- a first elbow sealing element housed both in the upstream groove and in the second groove, and
- a second elbow sealing element housed both in the first groove and in the downstream groove.

The use of elbow sealing elements allows stopping the leaks that may occur at the contact portions between the sealing tabs, that is to say, at the junctions between the grooves.

According to a particular characteristic of the ring assembly of the invention, each of the sealing tabs and each of the elbow sealing elements have a thickness comprised between 0.1 mm and 1 mm.

According to another particular characteristic of the ring assembly of the invention, each of the sealing tabs and each of the elbow sealing elements are made of a material chosen from one of the following materials: nickel, cobalt and tungsten based alloy.

According to a second aspect of the ring assembly of the invention, the upstream groove opens into the second groove and the downstream groove opens into the first and second grooves, in which ring assembly:

- the upstream sealing tab comprises first and second continuous portions forming an angle therebetween, the first portion extending into the upstream groove and the second portion extending partially into the second groove,
- the second sealing tab comprising first and second continuous portions forming an angle therebetween, the first portion extending into the second groove and the second portion extending partially into the downstream groove, the second portion of the upstream sealing tab overlapping the first portion of said second sealing tab,
- a downstream sealing tab comprises first and second continuous portions forming an angle therebetween, the first portion extending into the downstream groove and the second portion extending partially into the first groove, the second portion of the second sealing tab overlapping the first portion of the downstream sealing tab, the second portion of said downstream sealing tab overlapping the first sealing tab.

With sealing tabs including two continuous portions forming an angle therebetween, it is possible to prevent the leaks at the junction of two grooves without having to use additional elbow joints. The mounting of the inter-sector ring sealing systems is thus simplified and the production cost is reduced. The control of the placement of the sealing tabs is also simplified because they no longer need to cooperate with elbow joints as in the prior art.

According to a particular characteristic of the ring assembly of the invention, each of the sealing tabs has a thickness comprised between 0.1 mm and 1 mm.

According to another particular characteristic of the ring assembly of the invention, each of the sealing tabs is made of a nickel, cobalt or tungsten based metal alloy.

According to a particular characteristic of the ring assembly of the invention, each opening present in the second sealing tab has a surface comprised between 0.1 $mm^2$ and 10 $mm^2$.

According to a particular characteristic of the ring assembly of the invention, each opening present in the second sealing tab is entirely surrounded by the material of said second sealing tab.

According to another particular characteristic of the turbine ring assembly of the invention, each ring sector is made of ceramic-matrix composite material.

BRIEF DESCRIPTION OF THE DRAWINGS

The invention will be better understood upon reading the following, by way of indication but without limitation, with reference to the appended drawings in which.

DETAILED DESCRIPTION OF EMBODIMENTS

Figure 1:
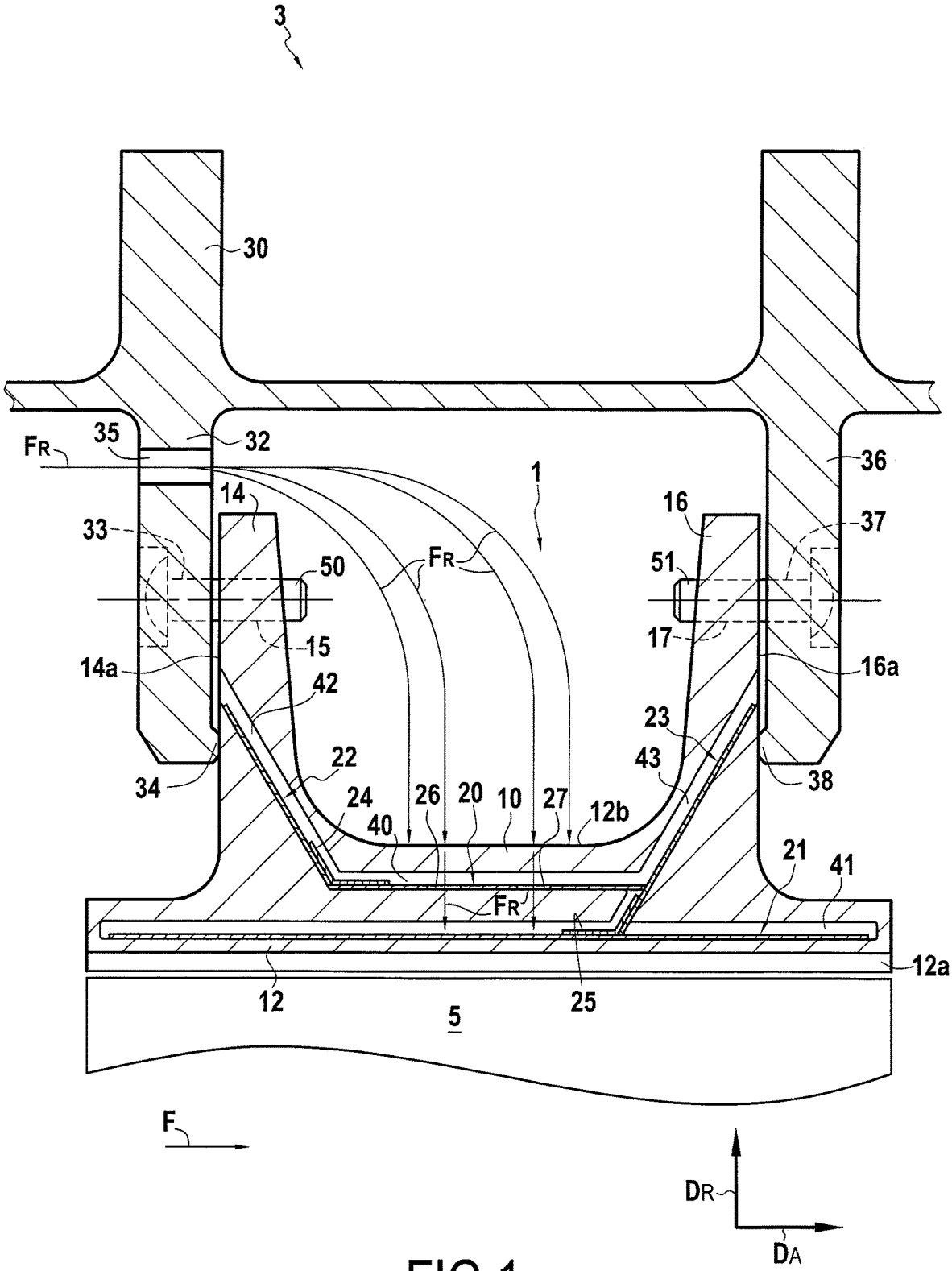
FIG. 1 is a radial half-sectional view showing an embodiment of a turbine ring assembly according to the invention.

FIG. 1 shows a high-pressure turbine ring assembly comprising a turbine ring 1, here made of ceramic-matrix composite (CMC) material comprising a plurality of adjacent ring sectors each having an annular base or platform 12, an upstream lug 14 and a downstream lug 16 protruding each radially outwardly from the platform 12. In the example described here, the turbine ring 1 surrounds a set of rotary airfoils 5. However, the ring assembly of the invention can also be formed by other turbine ring assemblies such as for example a turbine ring assembly comprising gas turbine diffuser sector vanes. In this case, the platform is a platform of a diffuser and the upstream and downstream lugs 14, 16 can carry sealing means and/or fixing means in order to come into sealed contact with the casing. In each case, the turbine ring 1 is formed of a plurality of adjacent ring sectors 10, FIG. 1 being a radial sectional view along a plane passing between two contiguous ring sectors. The arrow $D_A$ indicates the axial direction relative to the turbine ring 1 while the arrow $D_R$ indicates the radial direction relative to the turbine ring 1.

Each ring sector 10 has a section substantially in the form of an inverted Pi ($\pi$) with an annular base or platform 12 whose inner face 12*a* may be coated with an abradable material layer and/or a thermal barrier (not represented in FIG. 1). The inner face 12*a* defines the flowpath of a gas stream in the turbine. Upstream and downstream lugs 14, 16 extend from the outer face 12*b* of the platform 12 along the radial direction $D_R$. The terms "upstream" and "downstream" are used here with reference to the flow direction of the gas stream in the turbine (arrow F).

The ring support structure 3 which is secured to a turbine casing 30 comprises an annular upstream radial flange 32 including a lip 34 on its face opposite the upstream lugs 14 of the ring sectors 10, the lip 34 bearing on the outer face 14*a* of the upstream lugs 14. On the downstream side, the ring support structure comprises an annular downstream radial flange 36 including a lip 38 on its face opposite the downstream lugs 16 of the ring sectors 10, the lip 38 bearing on the outer face 16*a* of the downstream lugs 16.

The lugs 14 and 16 of each ring sector 10 are mounted between the annular flanges 32 and 36 and held therebetween by blocking pins. More specifically and as illustrated in FIG. 1, pins 50 are engaged both in the annular upstream radial flange 32 of the ring support structure 3 and in the upstream lugs 14 of the ring sectors 10. Indeed, the pins 50 each pass respectively through an orifice 33 arranged in the annular upstream radial flange 32 and an orifice 15 arranged in each upstream lug 14, the orifices 33 and 15 being aligned during the mounting of the ring sectors 10 on the ring support structure 3. Likewise, pins 51 are engaged both in the annular downstream radial flange 36 of the ring support structure 3 and in the downstream lugs 16 of the ring sectors 10. For this purpose, the pins 51 each pass respectively through an orifice 37 arranged in the annular downstream radial flange 36 and an orifice 17 arranged in each downstream lug 16, the orifices 37 and 17 being aligned during the mounting of the ring sectors 10 on the ring support structure 3.

According to the invention, the sealing of the ring is ensured by sealing tabs. More specifically, as represented in FIGS. 1, 2A and 2B, each ring sector 10 is provided with a first sealing tab 21 which here extends horizontally over almost the entire length of the platform 12, with a second sealing tab 20 disposed above the first horizontal tab along the radial direction $D_R$ and which here extends horizontally over part of the length of the platform 12, with an upstream sealing tab 22 which extends mainly along of the upstream lug 14 and with a downstream sealing tab 23 which extends mainly along the downstream lug 16.

Each sealing tab is housed in facing grooves in the edges opposite two neighboring ring sectors. To this end, each ring sector 10 includes a first groove 41 which here extends horizontally into the platform 12 in the vicinity of the inner face 12*a* thereof and in which the first sealing tab 21 is housed, a second groove 40 which here extends horizontally into the platform 12 in the vicinity of the outer face 12*b* thereof and above the groove 41 along the radial direction $D_R$, in which the second sealing tab 20 is housed, an upstream groove 42 arranged in the upstream lug 14 in which the upstream sealing tab 22 is housed and a downstream groove 43 arranged in the downstream lug 16 and in which the downstream sealing tab 23 is housed. The second groove 40 opens on one side into the radially inner part of the upstream groove 42 and on the other side in the radially inner part of the downstream groove 43. Thus, the second sealing tab 20 is in contact at one end with the upstream sealing tab 22 and in contact at the other end with the downstream tab 23. In addition, the downstream groove 43 opens into the first groove 41 so that the radially inner end of the downstream sealing tab 23 is in contact with the first sealing tab 21. The leaks are thus reduced by superimposing the tabs.

Figure 2A:
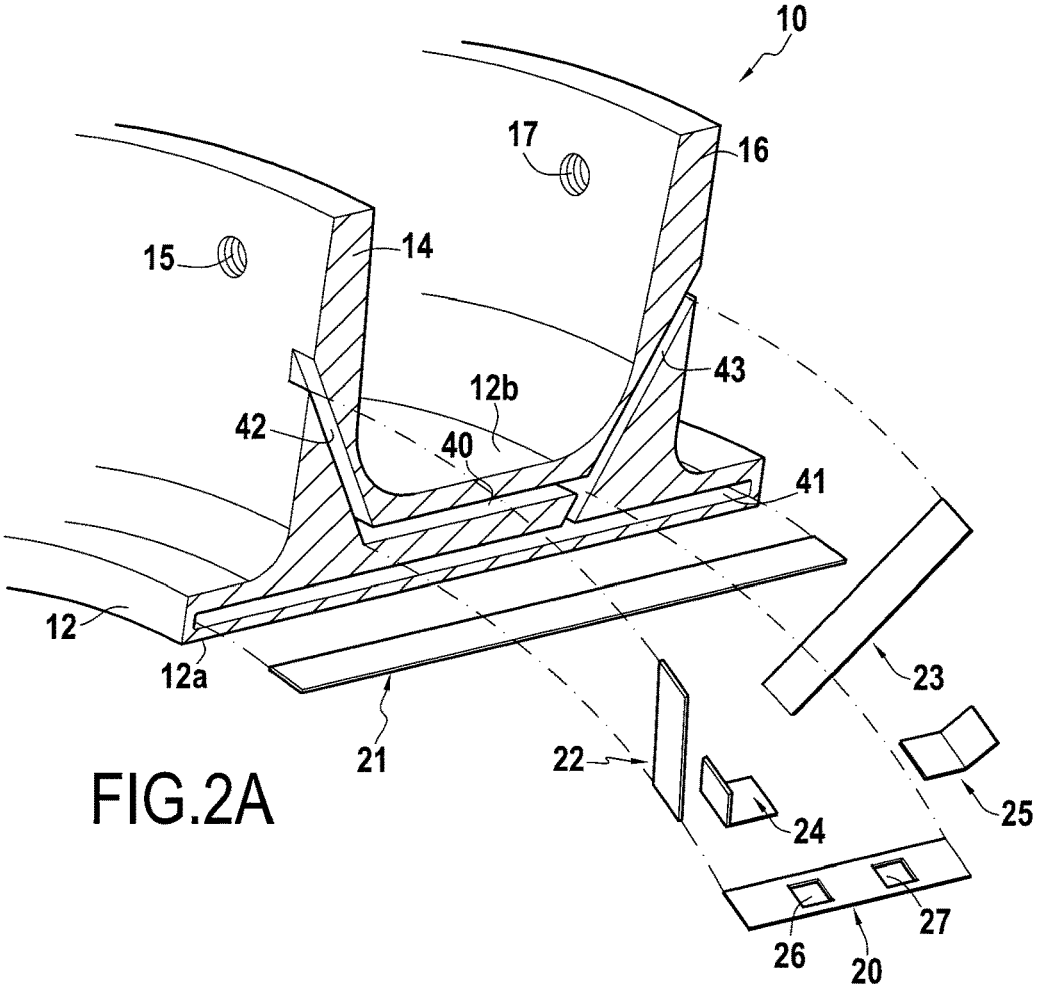
FIGS. 2A and 2B are partial schematic perspective views showing the positioning of sealing tabs in a ring sector of the turbine ring assembly of FIG. 1.
Figure 2B:
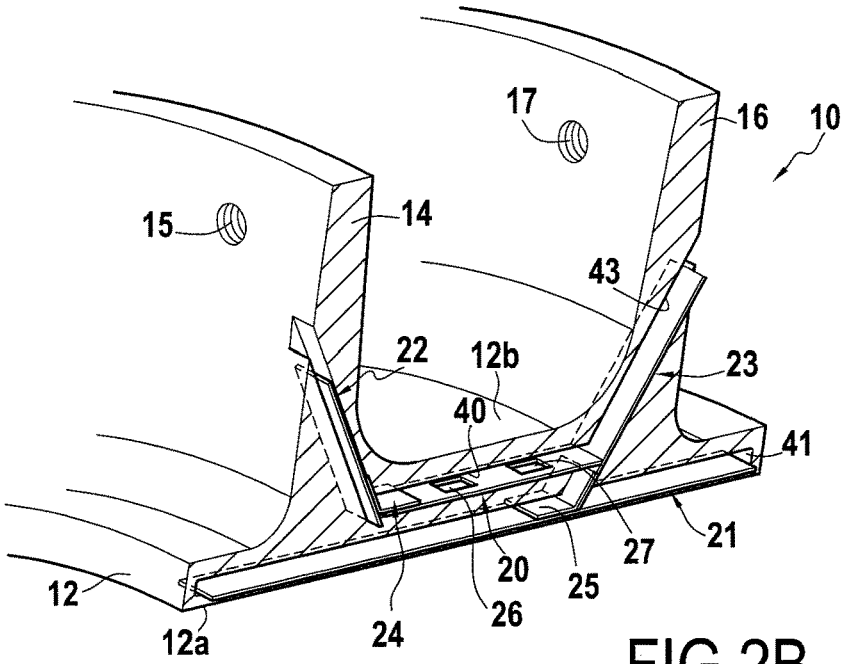

FIGS. 1, 2A and 2B illustrate a single ring sector 10 in which the tabs 20, 21, 22 and 23 are partially introduced respectively into the grooves 40, 41, 42 and 43. The part of the tabs 20, 21, 22 and 23 projecting from the ring sector 10 (FIG. 2B) are introduced into corresponding grooves arranged in the neighboring ring sector (not represented in FIGS. 1, 2A and 2B).

The tabs 20, 21, 22 and 23 are for example metallic and are preferably mounted with a cold clearance in the grooves 40, 41, 42 and 43 in order to ensure the sealing function at the temperatures encountered in service. By way of non-limiting examples, the sealing tabs can be made of a nickel, cobalt or tungsten based metal alloy.

Furthermore, a first sealing element or elbow joint 24 is housed both in the upstream vertical groove 42 and in the second groove 40 while a second sealing element or elbow joint 25 is housed both in the first groove 41 and in the downstream vertical groove 43. The elbow joints 24 and 25 can be formed from folded metal sheets. By way of non-limiting examples, the elbow joints can be made of a nickel, cobalt or tungsten based metal alloy.

As for the sealing tabs 20, 21, 22 and 23, the elbow joints 24 and 25 are partially introduced respectively into the grooves 42 and 40 and into the grooves 41 and 43. The part of the elbow joints 24 and 25 projecting from the ring sector 10 (FIG. 2B) are introduced into corresponding grooves arranged in the neighboring ring sector (not represented in FIGS. 1, 2A and 2B).

With two sealing tabs superimposed along the radial direction $D_R$ in the platform, a double sealing is made at the base of the ring which reinforces the inter-sector sealing in the ring while ensuring a redirection of the air circulating on the outer side of the ring towards the upstream, that is to say in the movable wheel formed by the rotary airfoils inside the ring. Furthermore, the use of the elbow joints 24 and 25 allow stopping the leaks that may occur at the contact portions between the sealing tabs, that is to say at the orthogonal junctions of the grooves. In the example described here, the elbow joint 24 prevents the leaks at the contact portion between the second tab 20 and the upstream vertical tab 22 while the elbow joint 25 prevents the leaks at the contact portion between the first tab 21 and the downstream vertical tab 23.

According to the invention, the second horizontal tab includes one or several opening(s). In the example described here, the second tab 20 includes two openings 26 and 27. The first tab 21 is located as close as possible to the inner face 12*a* of the platform 12 of the ring sector, that is to say, as close as possible to the flowpath. Therefore, it is the first horizontal tab 21 that is subjected to the highest temperatures. The openings 26 and 27 made in the second tab 20 allow cooling the first tab 21. Indeed, the outer face 12*b* of the platform 12 of each ring sector receives a cooling stream $F_R$ introduced inside the ring by ventilation elements that allow bringing the cooling stream onto the outer face 12*b* of the platform. In the example described here, the cooling stream $F_R$ is introduced through passages 35 present in the annular upstream radial flange 32 of the ring support structure 3, the cooling stream impacting the outer surface 12*b* of the platform after its entrance in each ring sector 10. In the case of a gas turbine, the cooling stream can be taken from the compressor stage or come from an air stream bypassing the combustion chamber. Thanks to the presence of the openings 26 and 27 in the second tab 20 which is located as close as possible to the outer face 12*b* of the platform 12 receiving the cooling stream $F_R$, a fraction of the cooling stream $F_R$ can reach the first tab 21 and cool it. The openings present in the second sealing tab allow creating local leak passages towards the first sealing tab. As these leak passages are local and controlled during the design of the sealing tabs, they have only a limited impact on the sealing function of the second tab. To this end, each opening present in the second sealing tab is preferably entirely surrounded by the material of the tab as illustrated in FIG. 2A in order to maintain a continuity of material over the entire length of the tab and, therefore, to limit the leaks at the openings. Furthermore, each opening has a surface comprised between 1 $mm^2$ and 10 $mm^2$. It is thus possible to increase the temperatures of the gases circulating in the flowpath on the side of the inner face 12*a* of the platform of the ring sectors without the risk of damaging the sealing tab most exposed to heat streams, namely the first horizontal tab 21.

The number and/or the shape of the openings made on the second tab are defined as a function of the cooling needs of the first horizontal tab.

Figure 3:
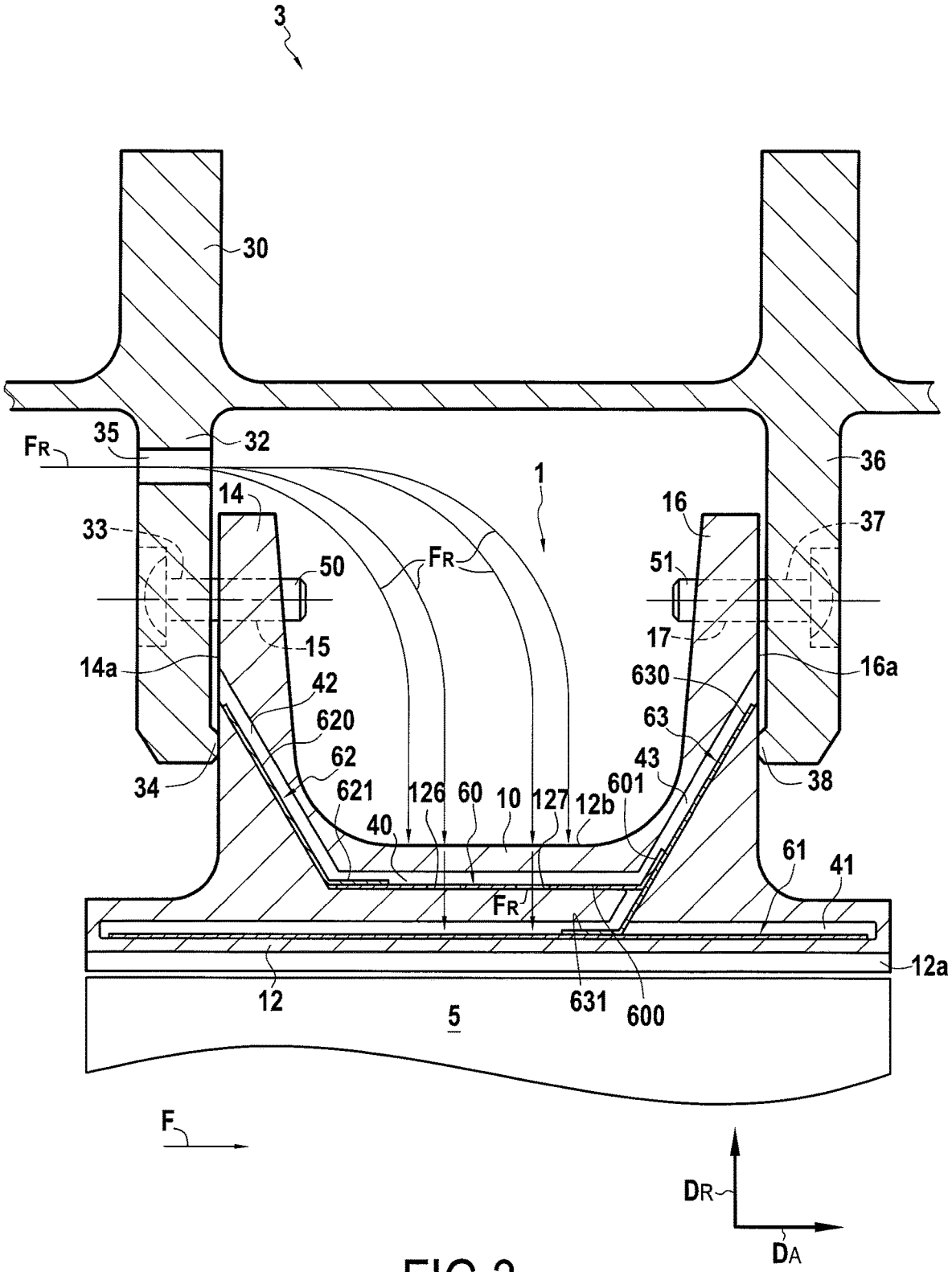
FIG. 3 is a radial half-sectional view showing another embodiment of a turbine ring assembly according to the invention.

FIG. 3 shows a turbine ring assembly according to another embodiment of the invention. In the example described here, the metal ring support structure 3 and the ring sectors 10 forming the turbine ring 1, here made of a ceramic-matrix composite (CMC) material, are identical to those already described above in relation to FIGS. 1, 2A and 2B and will not be described here again for the sake of simplicity.

Figure 4A:
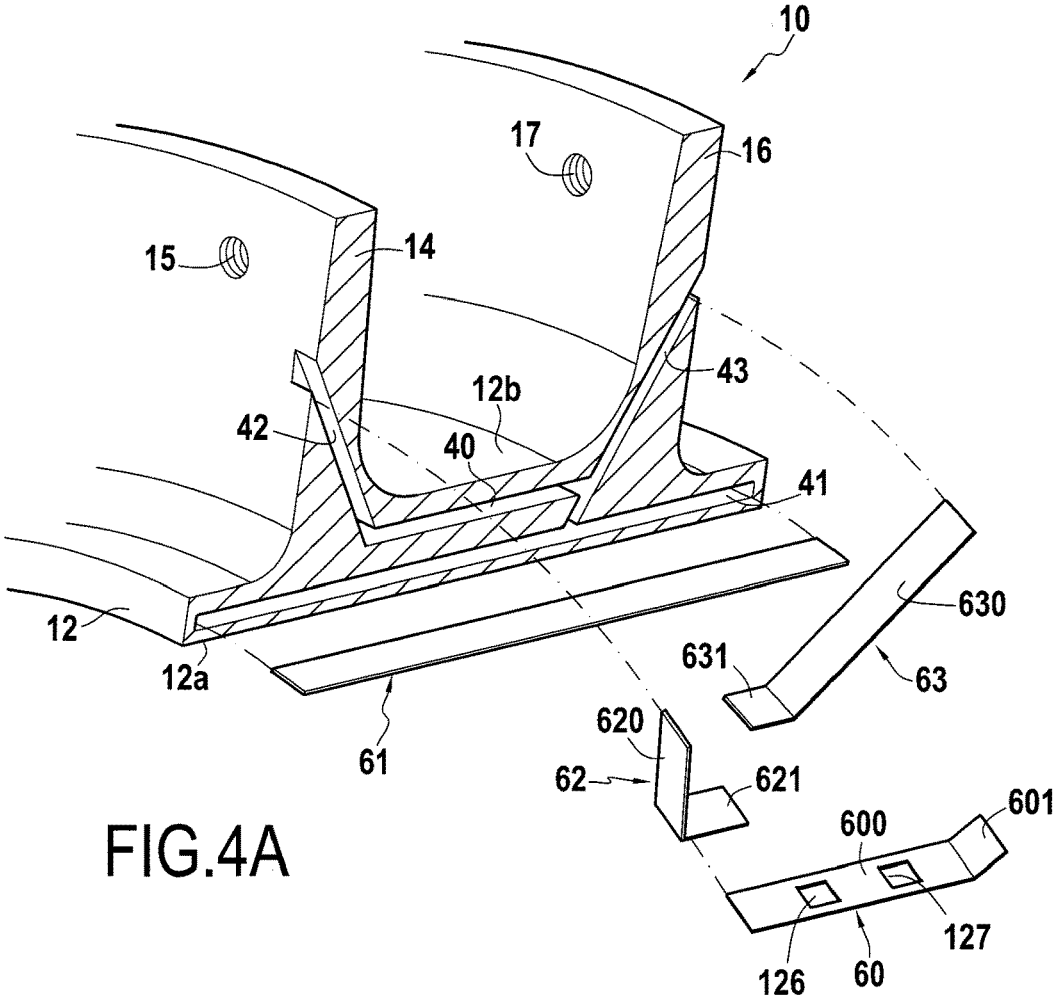
FIGS. 4A and 4B are partial schematic perspective views showing the positioning of sealing tabs in a ring sector of the turbine ring assembly of FIG. 3.
Figure 4B:
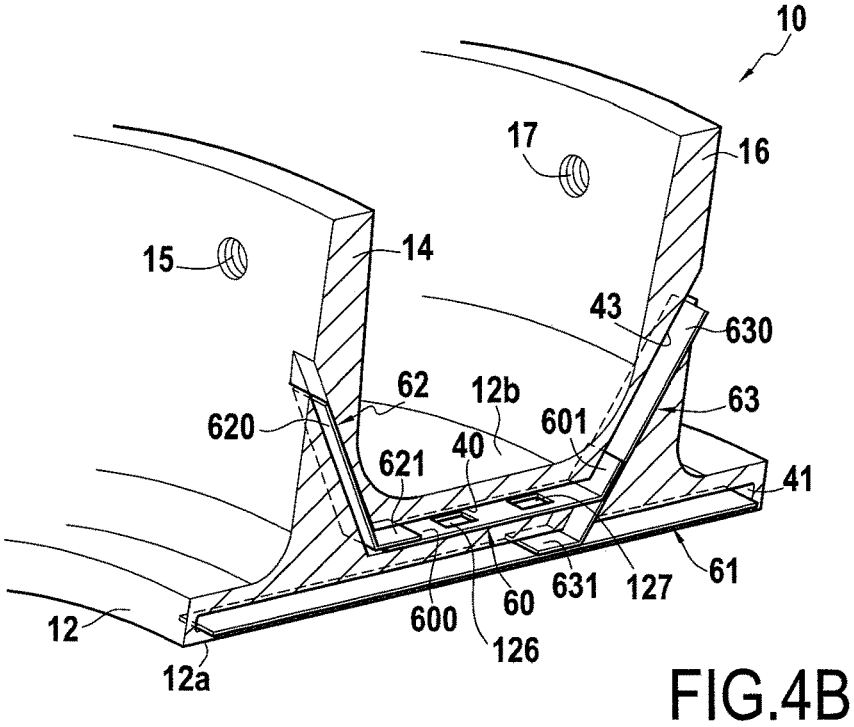

The turbine ring assembly represented in FIGS. 3, 4A and 4B differs from the turbine ring assembly previously described in relation to FIGS. 1, 2A and 2B in that some sealing tabs comprise two portions forming an angle therebetween so as to prevent the leaks at the junction of two grooves in the ring sectors, and this without having to use additional elbow joints as in the previous embodiment.

More specifically, as represented in FIGS. 3, 4A and 4B, each ring sector 10 is provided with a first sealing tab 61 which extends over almost the entire length of the platform 12, with a second sealing tab 60 disposed above the first tab along the radial direction $D_R$ and which extends over part of the length of the platform 12, with an upstream sealing tab 62 which extends mainly along the upstream lug 14 and with a downstream sealing tab 63 which extends mainly along the downstream lug 16.

Each sealing tab is housed in facing grooves in the edges opposite two neighboring ring sectors. To this end, each ring sector 10 includes a first groove 41 here extending horizontally into the platform 12 in the vicinity of the inner face 12*a* thereof, a second groove 40 extending here horizontally into the platform 12 in the vicinity of the outer face 12*b* thereof and above the groove 41 along the radial direction $D_R$, an upstream groove 42 arranged in the upstream lug 14 and a downstream groove 43 arranged in the downstream lug. The second groove 40 opens on one side into the radially inner part of the upstream groove 42 and on the other side into the radially inner part of the downstream groove 43. The downstream groove 43 also opens into the first groove 41.

The upstream sealing tab 62 comprises first and second continuous portions 620 and 621 forming an angle therebetween, the first portion 620 extending into the upstream groove 42 and the second portion 621 extending partially into the second groove 40. The second sealing tab 60 comprises first and second continuous portions 600 and 601 forming an angle therebetween, the first portion 600 extending into the second groove 40 and the second portion 601 extending partially into the downstream groove 23, the second portion 621 of the upstream sealing tab 22 overlapping the first portion 600 of the second sealing tab 20. The downstream sealing tab 23 comprises first and second continuous portions 630 and 631 forming an angle therebetween, the first portion 630 extending into the downstream groove 43 and the second portion 631 extending partially into the first groove 41. The second portion 601 of the second sealing tab 20 overlaps the first portion 630 of the downstream sealing tab 23 while the second portion 631 of the downstream sealing tab 23 overlaps the first sealing tab 21.

FIGS. 3, 4A and 4B illustrate a single ring sector 10 in which the tabs 60, 61, 62 and 63 are partially introduced respectively into the grooves 40, 41, 42 and 43. The part of the tabs 60, 61, 62 and 63 projecting from the ring sector 10 (FIG. 4B) are introduced into corresponding grooves arranged in the neighboring ring sector (not represented in FIGS. 3, 4A and 4B).

The sealing tabs have very small dimensions. Indeed, the sealing tabs intended to be placed between turbine ring sectors generally have a thickness comprised between 0.1 mm and 1 mm. The tabs 60, 62 and 63 can be made, for example, by additive manufacturing or by MIM (Metal Injection Molding) manufacturing: which allows forming directly very small sealing tabs with two continuous portions forming an angle. The shaping, for example by folding, of initially flat and very small metal material tabs turns out to be difficult, particularly as regards the control of the angle present between the two continuous portions of a tab. For example, a sealing tab having a thickness of less than 1 mm and including two continuous portions forming therebetween an angle comprised between 60° and 170° can be made by laser fusion.

The sealing tabs 60, 61, 62 and 63 can be made of metal material and are preferably mounted with a cold clearance in the grooves 40, 41, 42 and 43 in order to ensure the sealing function at the temperatures encountered in service. By way of non-limiting examples, the sealing tabs can be made of a nickel, cobalt or tungsten based metal alloy.

As indicated above, the second portion 621, which extends axially from the first portion 620 of the upstream sealing tab 62, overlaps the first portion 600 of the second sealing tab 60. Likewise, the second portion 601, which extends axially from the first portion 600 of the second sealing tab 60, overlaps the first portion 630 of the downstream sealing tab 63. Likewise, the second portion 631, which extends axially from the first portion 630 of the downstream sealing tab 63, overlaps the first sealing tab 61.

The use of sealing tabs including, in addition to a first main portion, a second portion continuous with the first portion which overlaps the adjacent sealing tab, it is possible to stop the leaks that may occur at the junction portions between the sealing tabs, that is to say at the junctions between the grooves, without having to use elbow joints or sealing elements as in the prior art. In the example described here:

- the second portion 621 of the upstream sealing tab 62 which overlaps the first portion 600 of the second sealing tab 60 prevents the leaks at the junction between the tabs 62 and 60 and at the junction of the grooves 42 and 40;
- the second portion 601 of the second sealing tab 60 which overlaps the first portion 630 of the downstream sealing tab 63 prevents the leaks at the junction between the tabs 60 and 63 and at the junction the grooves 40 and 43;
- the second portion 631 of the downstream sealing tab 63 which overlaps the first sealing tab 61 prevents the leaks at the junction between the tabs 63 and 61 and at the junction the grooves 43 and 41.

In addition, with two sealing tabs superimposed in the radial direction $D_R$ in the platform, a double sealing is made at the base of the ring which reinforces the inter-sector sealing in the ring while ensuring redirection of the air circulating on the outer side of the ring towards the upstream, that is to say in the movable wheel formed by the rotary airfoils inside the ring. Regarding the first horizontal groove 41, the latter is preferably made as close as possible to the inner face 12*a* of the platform 12 of the ring sector so that the first sealing tab 21 is located as close as possible to the flowpath. The inter-sector clearance and its impact on the top of the blades are thus reduced.

According to the invention, the second tab includes one or several opening(s). In the example described here, the second tab 60 includes two openings 126 and 127. The first tab 61 is located as close as possible to the inner face 12*a* of the platform 12 of the ring sector, that is to say, as close as possible to the flowpath. Therefore, it is the first tab 61 that is subjected to the highest temperatures. The openings 126 and 127 made in the second tab 60 allow cooling the first tab 61. Indeed, the outer face 12*b* of the platform 12 of each ring sector receives a cooling stream $F_R$ introduced inside the ring by ventilation elements that allow bringing the cooling stream onto the outer face 12*b* of the platform. In the example described here, the cooling stream $F_R$ is introduced through passages 35 present in the annular upstream radial flange 32 of the ring support structure 3, the cooling stream impacting the outer surface 12*b* of the platform after its entrance in each ring sector 10. In the case of a gas turbine, the cooling stream can be taken from the compressor stage or come from an air stream bypassing the combustion chamber. Thanks to the presence of the openings 126 and 127 in the second tab 60 which is located as close as possible to the outer face 12*b* of the platform 12 receiving the cooling stream $F_R$, a fraction of the cooling stream $F_R$ can reach the first tab 61 and cool it. It is thus possible to increase the temperature of the gases circulating in the flowpath on the side of the inner face 12*a* of the platform of the ring sectors without the risk of damaging the sealing tab most exposed to the heat streams, namely the first tab 61.

The number and/or the shape of the openings made on the second horizontal tab are defined as a function of the cooling needs of the first horizontal tab.

Each opening may for example have a square or round shape. The opening (s) are positioned on the second tab to open onto hot spots identified on the first tab. In addition, as indicated above, each opening present in the second sealing tab is preferably entirely surrounded by the material of the tab and/or has a surface comprised between 1 $mm^2$ and 10 $mm^2$. Comparative temperature simulations were carried out by calculation by the Holder. Simulations were performed with CMC ring sectors and sealing tabs as defined above. The simulations consisted of exposing the inner face of the platform of the ring sectors to a reference temperature above 1,000° C. while circulating a cooling stream on the outer face of the platform of the ring sectors. In a first simulation, the second sealing tab, that is to say the sealing tab closest to the outer face of the platform of the ring sectors receiving the cooling stream, does not include any openings. In a second simulation, the second sealing tab includes openings as described above. During each simulation, the maximum temperature reached by the first sealing tab was calculated. It is reduced by more than 10° C. when the second horizontal sealing tab includes openings. In addition, a decrease of approximately 30° C. has been calculated in the areas of the first sealing tab into which the openings present in the second sealing tab open. The impact of the openings made in the second sealing tab on the temperature reduction of the first sealing tab is seen here.

The invention claimed is:

1. A turbine ring assembly comprising a plurality of adjacent ring sectors forming a turbine ring extending circumferentially around an axial direction, each ring sector having a platform with, along a radial direction of the turbine ring, an inner face defining the inner face of the turbine ring and an outer face from which an upstream lug and a downstream lug extend along the radial direction, each ring sector comprising a first groove present in the platform in the vicinity of the inner face of said platform, a second groove present in the platform in the vicinity of the outer face of said platform, the first and the second groove extending along the axial direction of the turbine ring, an upstream groove extending radially into the upstream lug and a downstream groove extending radially into the downstream lug, a first sealing tab extending into the first groove, a second sealing tab extending into the second groove, an upstream sealing tab extending into the upstream groove and a downstream sealing tab extending into the downstream groove, wherein the second sealing tab includes one or several opening.

2. The ring assembly according to claim 1, wherein the upstream groove opens into the second groove, the downstream groove opens into the first and second grooves, and wherein each sector ring comprises:

a first elbow sealing element housed both in the upstream groove and in the second groove, and a second elbow sealing element housed both in the first groove and in the downstream groove.

3. The ring assembly according to claim 1, wherein each of the sealing tabs and each of the elbow sealing elements has a thickness comprised between 0.1 mm and 1 mm.

4. The ring assembly according to claim 3, wherein each of the sealing tabs and each of the elbow sealing elements are made of a nickel, cobalt or tungsten based metal alloy.

5. The ring assembly according to claim 1, wherein the upstream groove opens into the second groove and the downstream groove opens into the first and second grooves, and wherein:

the upstream sealing tab comprises first and second continuous portions forming an angle therebetween, the first portion extending into the upstream groove and the second portion extending partially into the second groove, the second sealing tab comprising first and second continuous portions forming an angle therebetween, the first portion extending into the second groove and the second portion extending partially into the downstream groove, the second portion of the upstream sealing tab overlapping the first portion of said second sealing tab, the downstream sealing tab comprises first and second continuous portions forming an angle therebetween, the first portion extending into the downstream groove and the second portion extending partially into the first groove, the second portion of the second sealing tab overlapping the first portion of the downstream sealing tab, the second portion of said downstream sealing tab overlapping the first sealing tab.

6. The ring assembly according to claim 1, wherein each of the sealing tabs has a thickness comprised between 0.1 mm and 1 mm.

7. The ring assembly according to claim 6, wherein each of the sealing tabs is made of a nickel, cobalt or tungsten based metal alloy.

8. The ring assembly according to claim 1, wherein each opening present in the second sealing tab has a surface comprised between 0, 1 $mm^2$ and 10 $mm^2$.

9. The ring assembly according to claim 1, wherein each opening present in the second sealing tab is entirely surrounded by the material of said second sealing tab.

10. The turbine ring assembly according to claim 1, wherein each ring sector is made of a ceramic-matrix composite material.

* * * * *